United States Patent [19]

Penrod

[11] 4,034,206

[45] July 5, 1977

[54] RANGE TOP ELEMENT

[75] Inventor: Glen H. Penrod, North Olmsted, Ohio

[73] Assignee: Gould Inc., Rolling Meadows, Ill.

[22] Filed: May 11, 1976

[21] Appl. No.: 685,331

[52] U.S. Cl. ..... 219/464; 219/463; 219/467; 219/541; 219/542; 338/288

[51] Int. Cl.[2] ..... H05B 3/68

[58] Field of Search ..... 219/460, 463, 464, 465, 219/466, 467, 468, 541, 542, 546, 552; 338/208, 209, 210, 212, 287, 288, 295, 297, 301, 308, 309

[56] References Cited

UNITED STATES PATENTS

| | | | |
|---|---|---|---|
| 2,231,236 | 2/1941 | Wentworth | 219/464 |
| 2,640,906 | 6/1953 | Haynes | 219/464 X |
| 3,372,487 | 3/1968 | Eisler | 219/542 X |
| 3,710,076 | 1/1973 | Frazier | 219/464 X |
| 3,749,883 | 7/1973 | Vodvarka et al. | 219/463 |
| 3,798,419 | 3/1974 | Maake | 219/541 |
| 3,833,793 | 9/1974 | McWilliams et al. | 219/464 |
| 3,912,905 | 10/1975 | Giler | 219/464 |

*Primary Examiner*—Volodymyr Y. Mayewsky
*Attorney, Agent, or Firm*—Edward E. Sachs

[57] ABSTRACT

A heating element assembly having a thermally conductive ceramic top sheet against the underside of which is positioned a thermally and electrically insulating base pod having a recess containing a loosely secured, planar array of thin, flat strips of apertured, foil-like, electrical resistance material. The array is spaced from the ceramic sheet a predetermined distance and disposed in such a manner as to provide a large amount of heat radiating surface adjacent to the underside of the ceramic top. The spacing between the array and the ceramic top sheet enhances even radiant heating of the ceramic top. Such a heating element assembly is low in cost and high in thermal efficiency, having particular utility as a burner for a ceramic top electric range.

10 Claims, 4 Drawing Figures

RANGE TOP ELEMENT

BACKGROUND OF THE INVENTION

The present invention is in the field of heating element assemblies for electric ranges.

More particularly, the present invention relates to a heating element assembly for a smooth surface ceramic top electric range. Prior art heating assemblies for such ranges included an insulating pod with a recess therein and a helically coiled heating element wrapped in a spiral manner within the recess. The element is attached to the floor of the recess by a suitable adhesive.

Another prior art arrangement is shown in U.S. Pat. No. 3,749,883, and includes an insulating pod having a recess therein which receives a tubular electric heating element which is shaped to a flat spiral. A metallic support member is formed of strip metal positioned on edge and bent to provide a pair of legs connected by a bite portion.

As is recognized by the patentees of that patent, difficulty has been encountered in the design of an electric heater for use with a ceramic panel because the composition of the latter becomes unstable under excessive heat and discolors or fractures. Attempts have been made to overcome this problem and have met with a certain degree of success. The patentees also recognize that such attempts have resulted in costly assemblies, and attention has been directed by those patentees to utilization of a sheathed, tubular electric heating element providing a flat, spiral heating surface. They also recognize that the tubular electric heating element is relatively expensive, but the low-cost assembly technique offsets the increased cost of the heating element.

Improved heating element assemblies utilizing a non-tubular, foil-like, electrical resistance material are disclosed in the copending application of Douglas H. Maake, Ser. No. 599,391, filed July 28, 1975, and in U.S. Pat. No. 3,798,419 to Douglas H. Maake, both assigned to the assignee of this application.

SUMMARY OF THE INVENTION

The present invention provides a heating assembly for a ceramic, smooth top electric range having improved thermal efficiency, faster heat-up and cool-down characteristics, and reduced power consumption.

A thermally and electrically insulating base pod having a recess containing a planar heating element array of thin, flat strips of apertured, foil-like, electrical resistance material is positioned against the underside of a thermally conductive ceramic top sheet.

The heating element array is contiguous with the floor of the recess and is spaced a predetermined distance from the ceramic top sheet, the predetermined distance being directly related to the depth of the recess in the base pod. The spacing between the array and the ceramic sheet enhances even radiant heating of the ceramic top sheet.

The planar heating element array contained within the recess is comprised of a plurality of constant width flat strips of apertured, foil-like electrical resistance material preferably in the form of a grid. The strips have a length and width substantially greater than their thickness. The strips are electrically connected end to end in series relationship and are geometrically arranged on the floor of the recess so that the strips are equidistantly spaced from each other to form an array having a generally circular periphery.

The areas defined by the lengths and widths of the strips are in a plane that is adjacent and parallel to the ceramic top sheet. Such an arrangement provides a large amount of heat radiating surface equidistantly spaced from the underside of the ceramic top sheet, thus enhancing even heating across the area of the ceramic sheet exposed to the heating effect of the array. Such a heating element assembly has excellent thermal characteristics, low assembly costs, and improved efficiency.

DESCRIPTION OF THE PREFERRED EMBODIMENT

Figure 1:
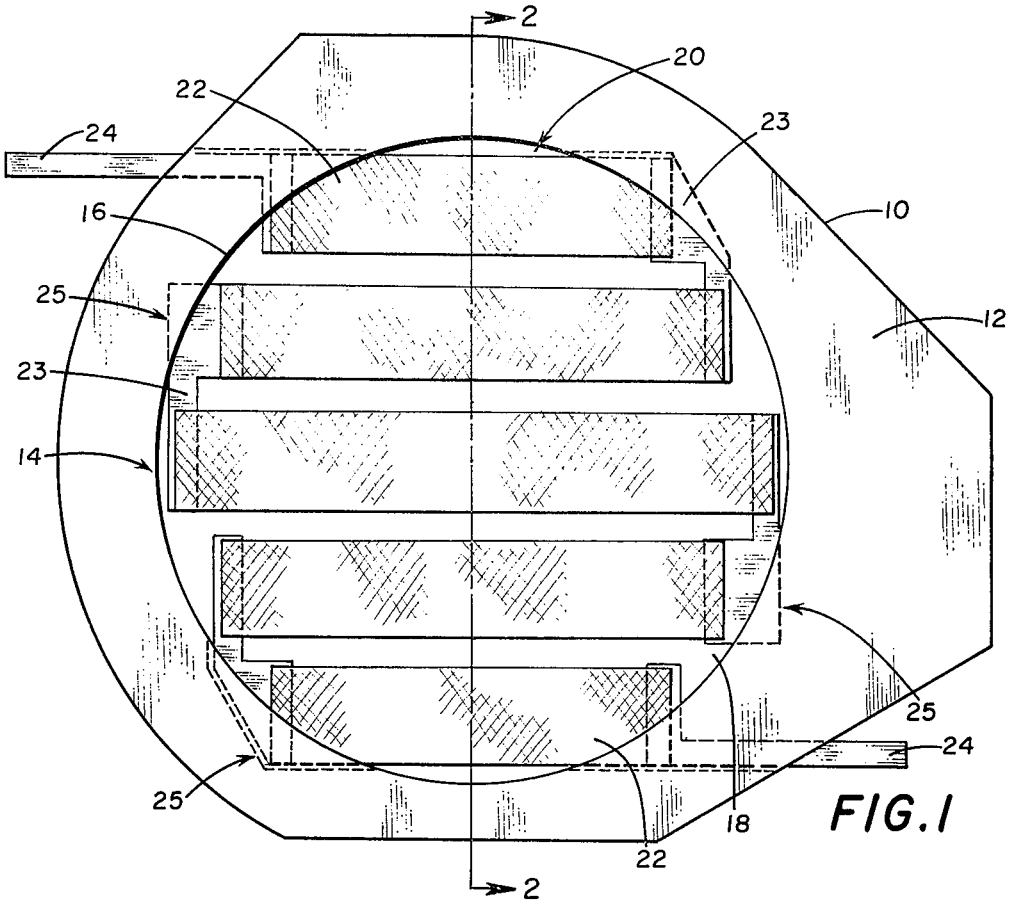
FIG. 1 is a plan view of a heating assembly in accordance with the present invention less the ceramic top sheet.

Referring now to the drawings, and more particularly to FIG. 1, there is illustrated a block-like base pod 10 which is formed of a suitable material, such as a kaolin clay-base ceramic fiber, capable of withstanding relatively high temperatures, being both thermally and electrically insulating. A face 12 of the block-like base pod 10 contains a generally cylindrical recess 14 defined by a circular wall 16 and a flat floor 18.

The floor 18 of the recess 14 supports a planar heating element array 20. The array 20 is formed of a plurality of flat, constant width strips 22 of apertured, foil-like, electrical resistance material, the strips 22 each having a length and width substantially greater than their thickness. The strips 22 are geometrically arranged in a plane wherein they are equidistantly spaced from each other.

Figure 2:
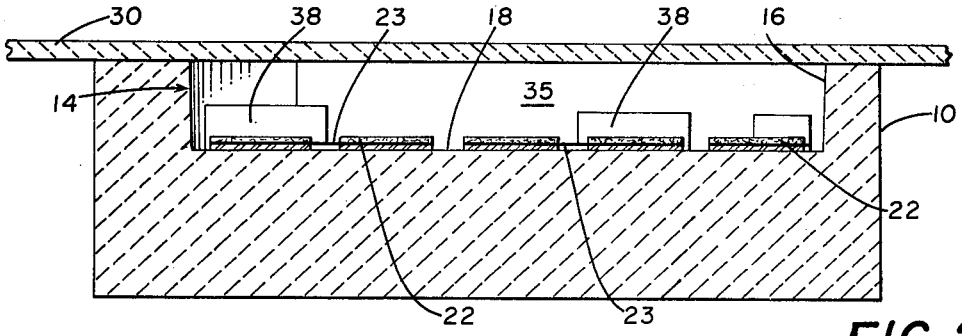
FIG. 2 is a not-to-scale cross sectional view along line 2—2 of the assembly shown in FIG. 1 positioned against the underside of a thermally conductive ceramic top sheet in accordance with the present invention.
Figure 3:
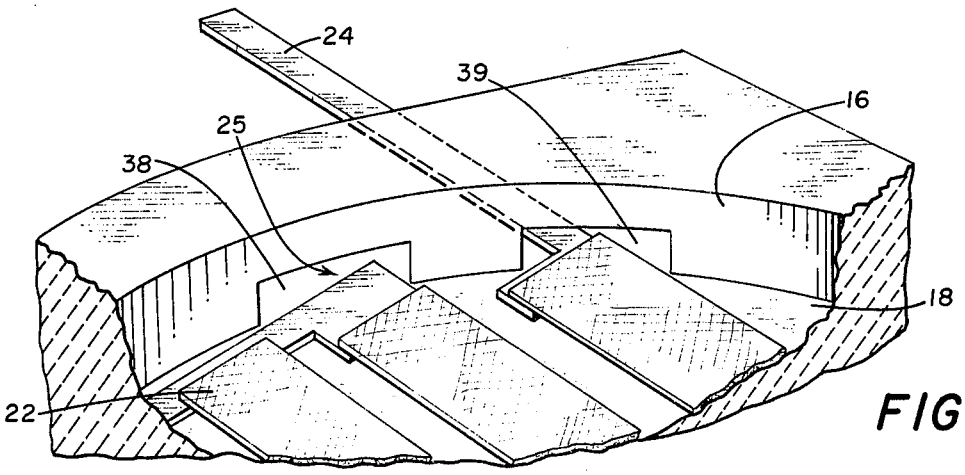
FIG. 3 is a perspective view of a section of the heating assembly illustrated in FIGS. 1 and 2, with the ceramic top sheet removed showing the access used to electrically connect the heating element array to an external power source (not shown)

The material used to form the strips 22 is a commercially available material having suitable electrical resistance characteristics. As shown in FIGS. 1, 2, and 3, the material forming the strips 22 has a diamond-shaped, expanded metal configuration, The expansion of the metal may be accomplished by first slitting a solid foil strip intermittently so that the entire sheet has a series of closely spaced, parallel cuts to permit expanding it laterally to form an open series. Furthermore, the material may be formed by repeatedly impacting and shearing diamond-shaped apertures in the foil, using conventional machinery. The resulting material has a high surface area-to-mass ratio and a faster heat-up and cool-down rate as compared to a coiled heating element of the prior art.

The strips 22 are electrically connected end to end in series relationship. The electrical interconnection of the strips 22 is accomplished by electrically conductive clips 23 which are fastened by mechanical crimping or spot welding to the appropriate ends of the conductive strips 22. Alternatively, the interconnection of the strips 22 could be accomplished by nonapertured, interconnecting bridges integrally formed with the strips 22 and composed of material identical to that of the strips 22.

Power tabs 24 extend laterally through the wall 16 and are used to electrically connect the array 20 with an appropriate external electrical power source (not shown).

The array 20 is loosely secured to the floor 18 of the recess 14 by peripheral portions 25 of the array 20 which extend, as indicated by the dashed lines illustrated in FIG. 1, into appropriate cavities 38 (shown more clearly in FIGS. 2 and 3) in the lower portion of the wall 16. Such an arrangement loosely secures the array 20 within the recess 14 and especially limits the axial movement of the array 20 while allowing for limited movement necessary for thermal expansion and contraction of the strips 22. Alternatively, the array 20 could be secured to the floor 18 by means of staples.

FIG. 2 illustrates a cross sectional view along line 2—2 of the heating element assembly illustrated in FIG. 1 positioned against the underside of a ceramic top sheet 30. The base pod 10 may be secured to the ceramic sheet 30 by biasing springs which bear against the underside of the pod, or by other suitable supports. The strips 22 interconnected by clips 23 rest on the floor 18 of the recess 14 of the base pod 10. The array 20 is spaced from the ceramic sheet 30 a predetermined distance approximately equal to the depth of the recess 14. This arrangement permits even radiant heating of the underside of the ceramic sheet 30.

When the recessed side of the base pod 10 is positioned against the underside of the ceramic top sheet 30, a cylindrical chamber 35 is formed which encapsulates the array.

FIG. 3 more clearly illustrates the extension of the power connection tab 24 through an aperture 39 which is located in a portion of the wall 16 adjacent to the floor 18 supporting the interconnected heating element strips 22. The aperture 39, besides providing access to chamber 35 for the electrical connection of the array to an external power source, can also function to limit the movement of the array, since portions of the array extend into the aperture 39.

Figure 4:
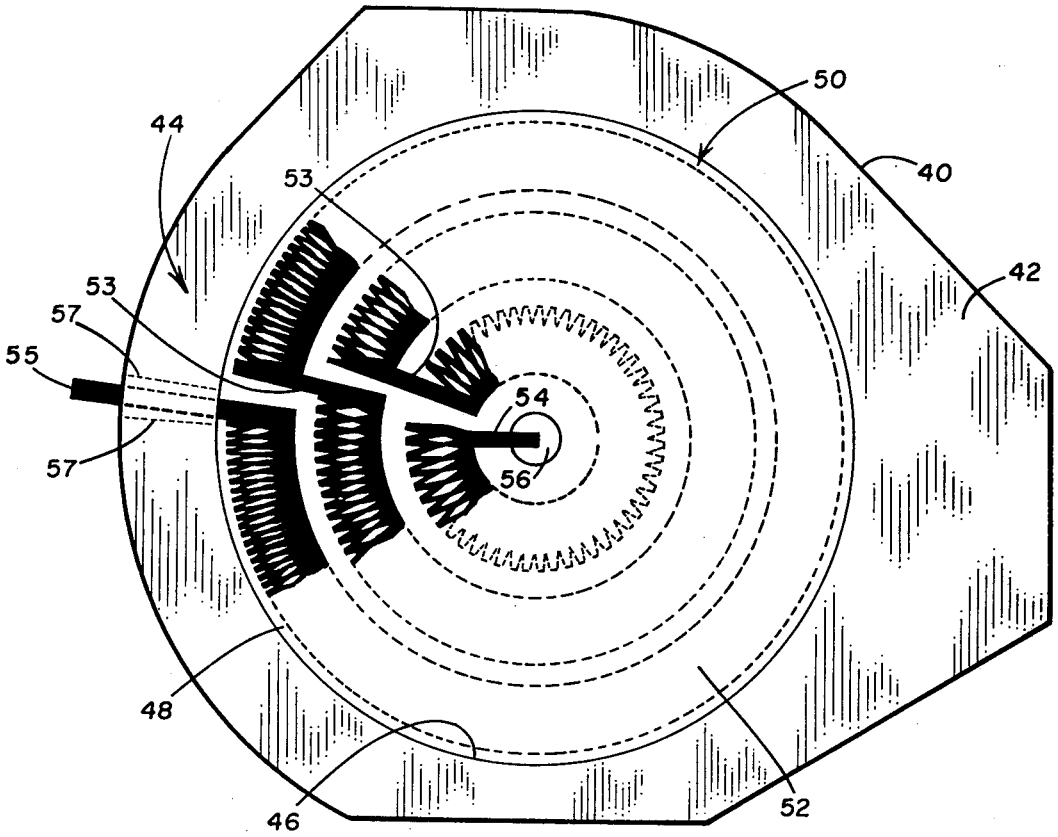
FIG. 4 is a plan view of a heating element assembly with the ceramic top sheet removed, illustrating an integrally formed heating element array of concentric circular strips equidistantly spaced from each other.

FIG. 4 illustrates another embodiment of the invention wherein a base pad 40 has a face 42 containing a generally cylindrical recess 44. The recess 44 has a circular wall 46 and a flat, circular floor 48.

The floor 48 supports heating element array 50 which includes a plurality of flat, constant width, circular strips 52 formed of apertured, foil-like, electrical resistance material. The circular strips 52 are discontinuous and geometrically arranged in a common plane on the floor 48. The strips 52 are equidistantly spaced from each other such that the strips 52 define a series of generally concentric circles having their centers in common with the center of said circular floor 48. The circular strips 52 are electrically connected to each other in series relation by integrally formed bridges 53. Electrical power is supplied via an integrally formed inner power tab 54 and an integrally formed outer power tab 55. The array 50, comprising strips 52, bridges 53 and power tabs 54,55, can be integrally formed using manufacturing techniques well known in the art, including mechanical punching, as earlier described. Alternatively, the array 50 could be formed by powder rolling wherein a flat face of a plate is coated with a suitable metallic powder. The flat face contains the design of the array pattern desired, including appropriate strip locations, interconnected bridges, and power connection tabs. Excess powder is removed such that only the etched areas contain metallic powder. Roller pressure is applied to the remaining powder, which is then sintered by appropriate means to form an array as illustrated in FIG. 4. Alternatively, the powder in the etched area could be pressured and sintered simultaneously. The array may also be formed by suitable photoetching techniques, wherein, for example, a thin, foil-like layer of suitable metal deposited on photographic film is selectively etched in accordance with a suitable array pattern photographically exposed on the film.

The inner power tab 54 is connected to a terminal 56 which extends through the floor 18 to a point on the outer surface of the pod at which an external power lead can be connected. Alternatively, a suitable aperture could be provided in place of the terminal 56 to allow access to the inner power tab 54 for connection to an external electrical power source. The outer power tab 55 extends through the wall 46 via an aperture schematically illustrated by dotted lines 57. In operation, the face 42 of the base pod 40 is positioned and held against the underside of a thermally conductive ceramic top sheet in the manner heretofore described.

Although preferred embodiments of this invention are illustrated, it is to be understood that various modifications may be resorted to without departing from the scope of the invention disclosed and claimed herein.

What is claimed is:

1. A heating element assembly comprising a thermally conducting electrically insulating rigid ceramic sheet;

a block of thermally and electrically insulating material, a face of said block having a wall projecting therefrom to define a recess in said block, said block being positioned against said ceramic sheet such that said recess and said sheet define a chamber;

and a planar heating element of apertured foil-like electrical resistance material, said element being contained in said chamber and being spaced from and in noncontiguous relationship with said ceramic sheet, the periphery of said element defining a plane parallel to said ceramic sheet, said wall containing a plurality of cavities, said cavities each containing a peripheral portion of said element, said planar heating element of apertured foil-like electrical resistance material being in the form of an array of thin flat strips, said strips being equidistantly spaced from each other and electrically connected to each other.

2. A heating element assembly according to claim 1, wherein said material is an expanded metal foil grid.

3. A heating element assembly according to claim 1, wherein said element is integrally formed by powder rolling.

4. A heating element assembly according to claim 1, wherein said element is integrally formed by photographic etching.

5. A heating element assembly according to claim 1, wherein said strips are electrically connected in end-to-end series relation.

6. A heating element assembly according to claim 1, wherein said strips are straight and parallel to each other.

7. A heating element assembly according to claim 1, wherein said strips are circular, said strips being arranged to form a series of concentric circles.

8. A heating element according to claim 1, wherein said wall defining said recess has at least one aperture, said aperture being useful for electrically connecting said array to an electrical power source external to said chamber.

9. A heating element assembly according to claim 8, wherein said chamber is generally cylindrical.

10. A heating element assembly comprising a thermally conducting electrically insulating rigid ceramic sheet;

a block of thermally and electrically insulating material, a face of said block having a wall projecting therefrom to define a recess in said block, said block being positioned against said ceramic sheet such that said recess and said sheet define a chamber;

and a planar heating element of apertured foil-like electrical resistance material, said element being contained in said chamber and being spaced from and in noncontiguous relationship with said ceramic sheet, said element defining a plane parallel to said ceramic sheet, said heating element of apertured foil-like electrical resistance material being in the form of an array of thin flat strips of constant width, said strips being equidistantly spaced from each other and electrically connected in end to end series relation, said wall containing a plurality of cavities, said cavities each containing a peripheral portion of said array.

* * * * *